US006257999B1

(12) United States Patent
Dahm

(10) Patent No.: US 6,257,999 B1
(45) Date of Patent: Jul. 10, 2001

(54) RACKET FOR A BALL TO BE HIT AND GUIDED ON THE GROUND

(76) Inventor: Karin Dahm, Lange Str. 66-68, D-31515, Wunstorf (DE)

( * ) Notice: Subject to any disclaimer, the term of this patent is extended or adjusted under 35 U.S.C. 154(b) by 0 days.

(21) Appl. No.: 09/242,875

(22) PCT Filed: Aug. 22, 1997

(86) PCT No.: PCT/DE97/01865

§ 371 Date: Feb. 25, 1999

§ 102(e) Date: Feb. 25, 1999

(87) PCT Pub. No.: WO98/08577

PCT Pub. Date: Mar. 5, 1998

(30) Foreign Application Priority Data

Aug. 30, 1996 (DE) ..... 196 35 212

(51) Int. Cl.[7] ..... A63B 59/12
(52) U.S. Cl. ..... 473/563; 473/560
(58) Field of Search ..... 473/560–563, 473/532, 526

(56) References Cited

U.S. PATENT DOCUMENTS

| | | | | |
|---|---|---|---|---|
| 4,076,240 | * | 2/1978 | Haddad | 473/563 |
| 4,135,717 | * | 1/1979 | DiLeo | 473/532 |
| 4,340,224 | * | 7/1982 | Staats | 473/563 |
| 4,360,201 | * | 11/1982 | Biehl et al. | 473/526 |
| 5,407,195 | * | 4/1995 | Tiitola et al. | 473/563 |
| 5,443,575 | * | 8/1995 | Huang | 473/533 |
| 5,609,336 | * | 3/1997 | Tashjian | 473/560 |
| 5,632,481 | * | 5/1997 | Unger et al. | 473/563 |
| 5,935,029 | * | 8/1999 | Cyr et al. | 473/563 |

FOREIGN PATENT DOCUMENTS

| | | | | |
|---|---|---|---|---|
| 2717 | * | 2/1910 | (GB) | 473/FOR 189 |
| 94021334 | * | 2/1910 | (WO) | 473/FOR 189 |

* cited by examiner

*Primary Examiner*—Mark S. Graham
(74) *Attorney, Agent, or Firm*—Flanagan & Flanagan; John R. Flanagan; John K. Flanagan

(57) ABSTRACT

A racket for a ball to be hit and guided at the ground includes a frame of an oval shape and surrounding a central opening through the frame. The frame has opposite arcuate-shaped top and bottom portions being oppositely curved away from another and opposite arcuate-shaped lateral end portions extending between the top and bottom portions and being oppositely curved away from one another so as to provide the frame with the oval shape. The racket also includes a striking face mounted to the frame and extending across the central opening thereof and an elongated shaft joined with the frame at one of the arcuate-shaped lateral end portions thereof and extending from the frame in a generally tangential relationship to the frame. The striking face has a pair of opposite sides. The frame at the bottom portion thereof has a bottom surface and opposite inner faces adjacent to the bottom surf ace being concavely shaped and converging with the opposite sides of the striking face and with the bottom surface of the frame to form therewith a sharply cornered angle. The bottom portion of the frame is wider than the top portion thereof in cross section so as to reinforce the bottom portion of the frame to withstand coming into contact with the ground during play.

21 Claims, 3 Drawing Sheets

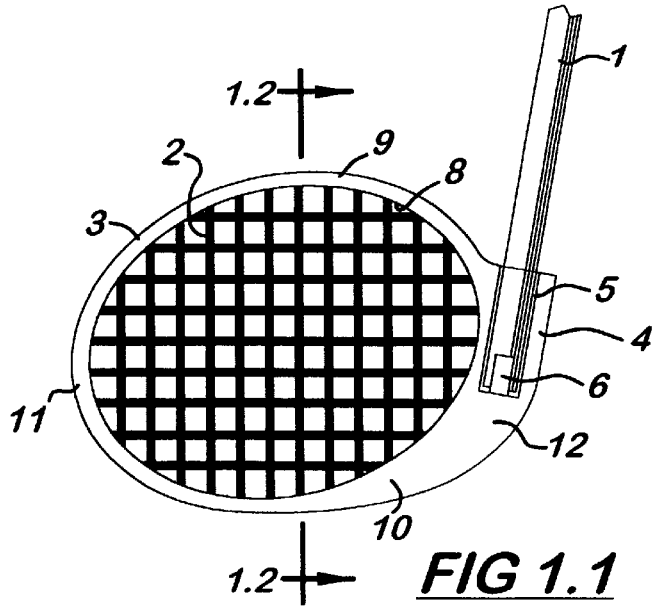
FIG 1.1
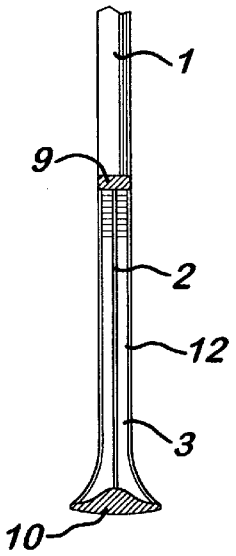
FIG. 1.2
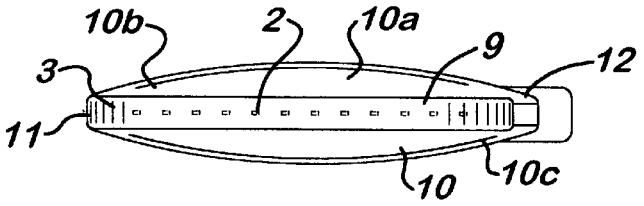
FIG. 1.3
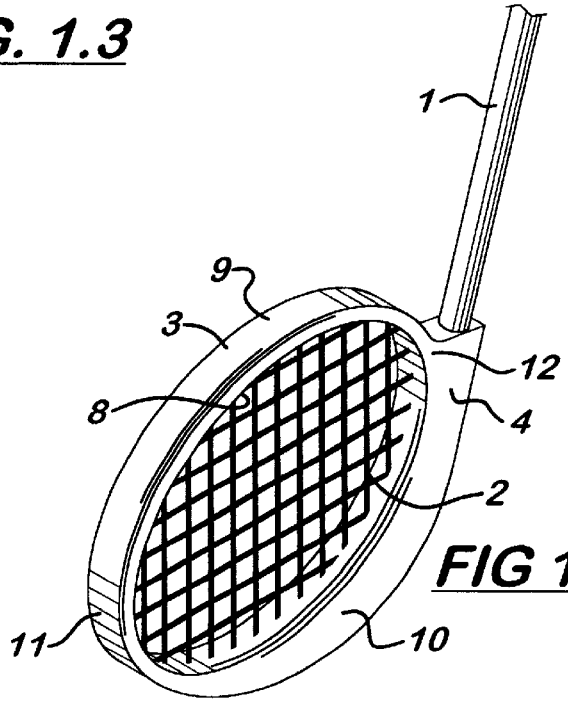
FIG 1.4

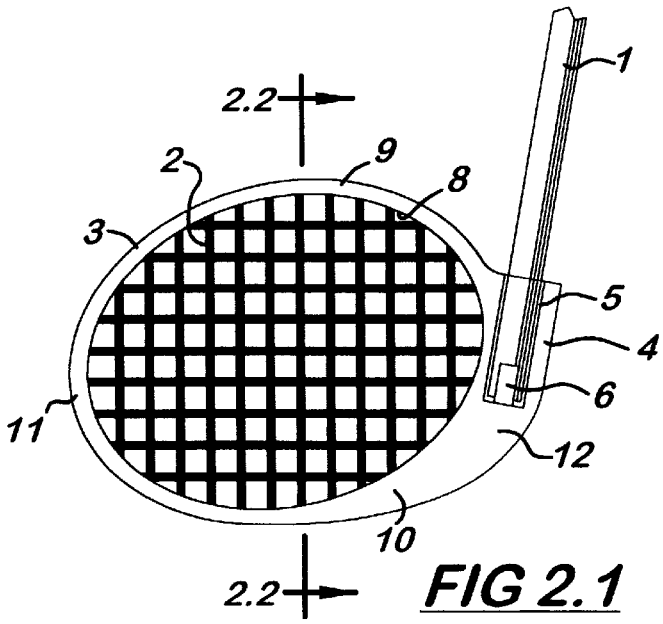
FIG 2.1
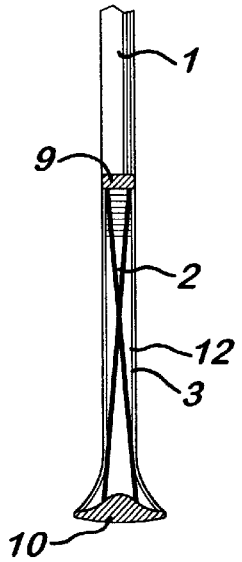
FIG. 2.2
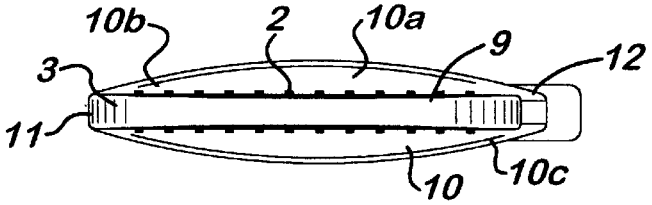
FIG. 2.3
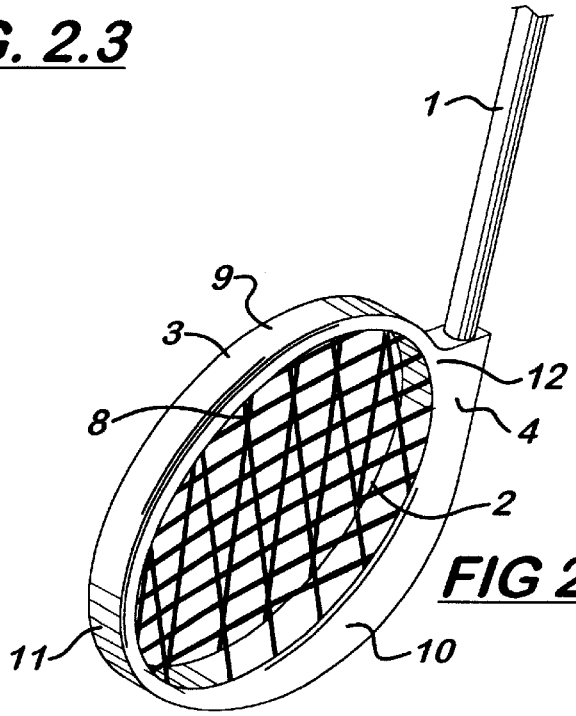
FIG 2.4

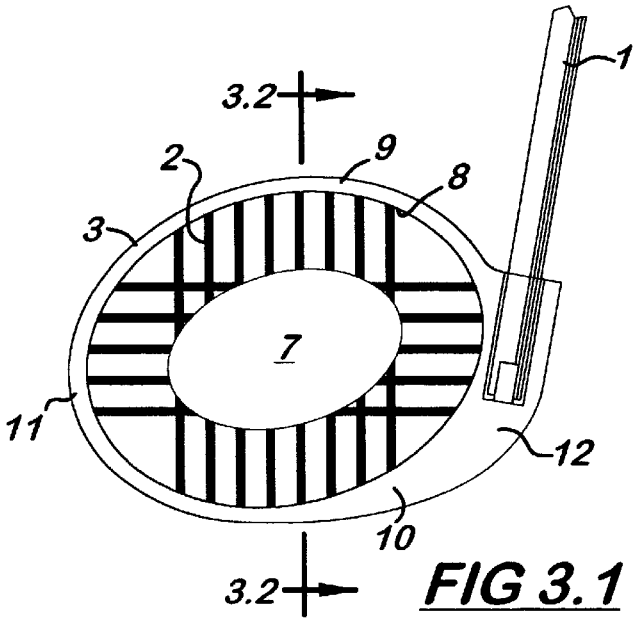
FIG 3.1
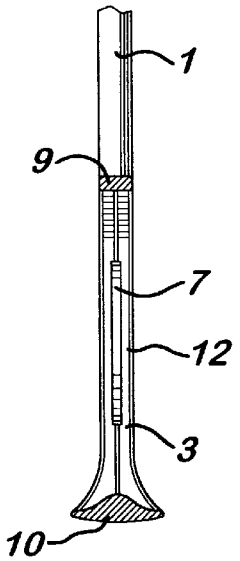
FIG. 3.2
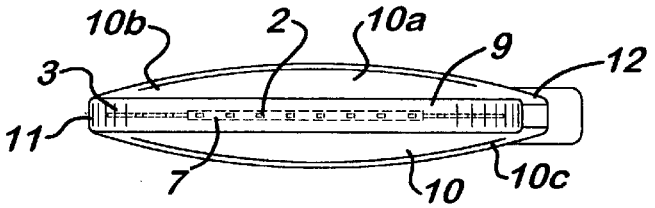
FIG. 3.3
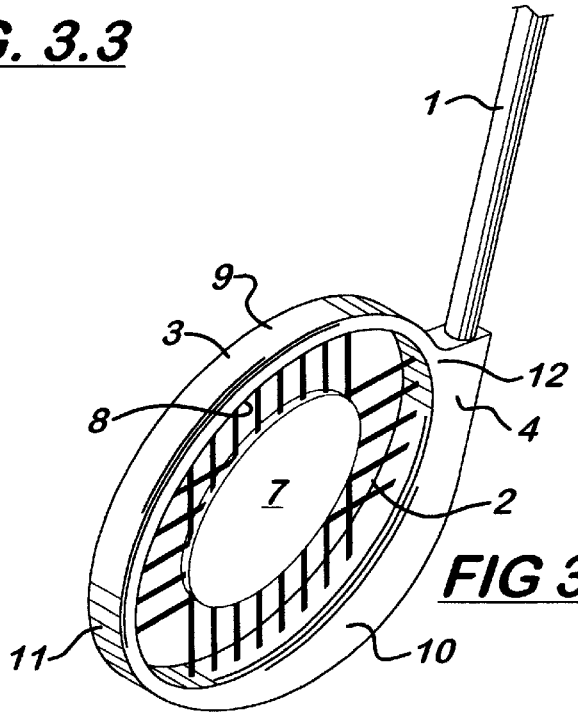
FIG 3.4

RACKET FOR A BALL TO BE HIT AND GUIDED ON THE GROUND

BACKGROUND OF THE INVENTION

1. Field of the Invention

The invention relates to rackets for hitting game playing objects and, more particularly, is concerned with a racket for a ball to be hit and guided (advanced, or "stick-handled") at the ground, comprising a shaft and a grid structure striking face extending angularly from said shaft.

2. Description of the Prior Art

In sports and pastime activities, a large number of rackets (also referred to as sticks, bats, clubs or similar) are known. Among these are a first group of rackets comprising shafts disposed as an extension of the longitudinal axis of a relatively large striking face (tennis, squash, badminton, table tennis "rackets" etc.) as well as a further group of rackets comprising a relatively small striking face extending angularly away from the shaft (e.g. ice hockey, street hockey, field hockey and golf "rackets").

U.S Pat. No. 4,340,224 discloses a racket (stick) for ice hockey goalkeepers comprising a surface extending from the shaft in angular fashion and, connected thereto, a surface of the same width arranged in extension of the stick shaft. Both faces comprise a frame in which a net made of nylon or leather strings are tension mounted. The purpose of this net is to avoid or at least diminish rebounds of the puck from the stick. Otherwise, this stick is in no way different from the typical construction of an ice hockey goalkeeper's stick.

U.S. Pat. No. 3,720,410 relates to a ball hockey stick with a closed, dished striking face arranged angularly in relation to the shaft, whereby between said striking face and said shaft there is provided a striking face also angular in relation to the shaft and diverging in relation to the dished striking face. Hereby, the dished striking face serves for hitting a ball while the diverging striking face is meant for guiding (handling) a ball.

EP 0 74 339 A1 teaches a tennis racket deviating from the typical construction for tennis rackets. While its striking face and its shaft, each viewed on its own, correspond to the hitting face and the shaft of a typical tennis racket, the longitudinal axis of the essentially oval striking face is disposed angularly in relation to the shaft whereby the extended axis of the shaft runs through the center of the striking face.

BRIEF SUMMARY OF THE INVENTION

It is the object of the present invention to provide a completely new type of racket for a ball to be hit and guided on the ground.

This task is solved by means of a racket of the aforementioned kind in that its striking face essentially exhibits the shape and size of a typical tennis, squash, badminton or table tennis racket, its shaft joining at one lateral end of the striking face end, and the frame being reinforced in its bottom area.

At first glance, the features stated in the main claim for the racket according to the invention appear to be simplistic. It is a fact, however, that the above-mentioned groups of rackets were co-existing for decades where no one proposed a novelty as in this invention. The present invention breaks new ground, leaving old, well known paths. The result is a racket giving a completely new optical impression unifying one element of the aforementioned first group of rackets, namely the hitting face, with an element of the second group of rackets, namely the shaft disposed angularly in relation to the striking face in the plane of the striking face. The racket can be used for hitting and guiding (handling) a ball on the ground, and this can be used for playing on roller blades or roller skates or on foot as well as on the ice with skates.

BRIEF DESCRIPTION OF THE DRAWINGS

Advantageous embodiments of the racket are specified in the subclaims.

This invention is subsequently further illustrated by means of embodiment examples. The accompanying schematic drawing shows in:

FIG. 1.1 a side view of a racket in a first embodiment,

FIG. 1.2 a cross section according to FIG. 1.1,

FIG. 1.3 an elevated view of the racket according to FIG. 1.1,

FIG. 1.4 a perspective view of the racket according to FIGS. 1.1 through 1.3, FIG. 2.1 a side view of a racket in a second embodiment, FIG. 2.2 a section according to FIG. 2.1, FIG. 2.3 an elevated view of the racket according to FIG. 2.1, FIG. 2.4 a perspective view of the racket according to FIGS. 2.1 through 2.3, FIG. 3.1 a side view of a racket in a third embodiment, FIG. 3.2 a second according to FIG. 3.1, FIG. 3.3 an elevated view of the racket according to FIG. 3.1, and FIG. 3.4 a perspective view of the racket according to FIGS. 3.1 through 3.3.

DETAILED DESCRIPTION OF THE INVENTION

In the following, at first, features will be described that are present in all embodiment examples. Subsequently, the differences will be illustrated.

Since the shaft 1 of the racket is shown broken off in all representations, it should be pointed out that the shaft 1 is shorter and steeper pitched than that of an ice hockey stick. Moreover, the racket is constructed very lightly, so that it can be played essentially one-handed both forehand as well as backhand. The ball used to play is a plastic foam ball having a diameter of at least 5 cm. This combination of light racket and foam ball makes the game relatively safe since both the danger of injury of players engaging each other by handling the racket as well as the risk of third party personal or property damages by the soft ball is minimal.

The striking face 2 of the rackets is framed. It is of about the size and shape of the striking face of a tennis racket. From the drawing it can be seen that the frame 3 in its lower area starting at its front is consistently growing wider, while simultaneously gaining in strength, and then, approximately in the middle, starts to become narrower again. This construction serves to reinforce the frame 3 at its bottom, i.e. in the area coming into contact with the ground during play. In addition, the frame 3 is made of wear-resistant material.

As can best be seen from FIGS. 1.1, 2.1, and 3.1, the strength of the frame in its bottom area consistently increases from its front end up to its shaft-side end. Here, the frame 3 terminates upwards in a plug joint 4 for the shaft 1. This plug joint 4 comprises a pocket bore 5 with a cylindrical pin 6 at the bottom of the bore. The shaft 1 can be plugged into the pocket bore 5 and onto the pin 6. It can be glued into the pocket bore 5 in order to attain a permanently fixed connection with the striking face 2 or, if a detachable connection is preferred, splinted or screwed to said bore, for example. Likewise, of course, striking face 2 and shaft 1 can be formed as one piece.

It can be seen from the sectional representations according to FIGS. 1.2, 2.2, and 3.2, that the frame 3 in its bottom area is formed concavely at its interior face on both sides of the striking face 2 and converges with the bottom of the frame, on both sides, always at a sharp-cornered angle. This shape facilitates elevating a ball lying or rolling on the ground.

Now, having describe above the features common in all three embodiment examples, the differences shall be explained in the following.

The racket according to FIGS. 1.1 through 1.4 comprises a grid-type, level striking face 2. The grid can be made of a rigid plastic grid; in this case, it would be practical to manufacture the frame 3 and the plastic grid as a one-piece pressure die-casting member. However, it may also be generated by strings being tension mounted in the frame 3, as known from tennis rackets.

The racket according to the FIGS. 2.1 through 2.4, likewise, exhibits a grid-type striking face 2. This consists of two intersecting, level string faces. The strings of each face extending essentially vertically are tension mounted between the left upper edge of the frame 3 and the right lower edge of the frame 3 or, respectively, between the right upper edge of the frame 3 and the left lower edge of the frame 3, as can best be seen from FIG. 2.2. The result is a striking face 2 essentially concave on both sides. This construction of the striking face 2 allows the ball to be hit angularly upwards or downwards, facilitated by a corresponding hitting technique.

In a racket according to FIGS. 3.1 through 3.4 the striking face 2 also consists of a plastic grid which, however, comprises a closed central area 7. This central area 7 can be covered with an optically pleasant printing or used as an advertising surface, for example.

Of course, besides the embodiment examples represented in the drawings, many further variations of rackets constructed according to the invention are conceivable. Thus, the shaft 1 could terminate, at its lower end, following the contours of the striking face, in a groove open towards the front or the top respectively. This can most easily be conceived if one looks at, for example, FIG. 1.1 and imagines the plug-in joint 4 with the connected reinforced frame 3 as integral parts of the shaft 1. In this case, the frame 3 would be of consistent strength over its entire perimeter and would be inserted into the open, U-shaped groove of the shaft terminal and fixed there. In this case, the shaft terminal forms the bottom side reinforcement of the racket. This embodiment of the racket allows replacement or exchange of the striking face 2.

In the racket according to FIGS. 1.1 through 1.4, likewise, it would be possible to replace the shown plastic grid. To that end, the frame 3 would have to be slitted in the plane of the striking face, the slit being through in its upper area and not through in its shaft-side and lower area, i.e. the slit forms, in the latter areas, a groove extending in the center of the frame in the width of the plastic grid. The depth of the groove must be dimensioned such that the plastic grid is safely supported laterally. The plastic grid can then be inserted into the slit from above until it is firmly seated in the groove in the frame 3. Its edge area will then be in contact with the frame 3 on both sides over the entire perimeter. The slit in the frame 3 can be closed, following insertion of the striking face 2, for example, by means of a T-shaped flexible impression band.

It would be sensible to equip the racket with a telescopical shaft in order to be able to adapt the length of the shaft to the height of the player, which might change, for example, for the only reason that the game is played on roller blades instead of on foot.

What is claimed is:

1. Racket for a ball to be hit and guided at the ground, said racket comprising:

(a) a frame of an oval shape and surrounding a central opening defined through said frame, said frame having opposite arcuate-shaped top and bottom portions being oppositely curved away from one another and opposite arcuate-shaped lateral end portions extending between said top and bottom portions and being oppositely curved away from one another so as to provide said frame with the oval shape;

(b) a striking face mounted to said frame and having a grid structure extending across said central opening of said frame such that said frame and said striking face together substantially resemble a head of a tennis racket, said bottom portion of said frame having a middle section and opposite end sections extending away from said middle section such that said bottom portion in cross section is wider at said middle section than at said opposite end sections so as to protrude in opposite directions away from opposite sides of said striking face and reinforce said bottom portion of said frame to withstand coming into contact with the ground during play; and (c) an elongated shaft being substantially straight and joined at one end with said frame at one of said arcuate-shaped lateral end portions thereof and extending from said frame in a generally tangential relationship to said frame.

2. The racket of claim 1 wherein said striking face is formed by strings.

3. The racket of claim 1 wherein said striking face is formed by a plastic grid.

4. The racket of claim 3 wherein said plastic grid closes a central portion of said central opening of said frame.

5. The racket of claim 1 wherein:

said striking face has a pair of opposite sides; and said frame at said bottom portion thereof has a bottom surface and opposite inner faces adjacent to said bottom surface, each of said inner faces being concavely shaped and converging with one of said opposite sides of said striking face and with said bottom surface of said frame to form therewith a sharply cornered angle.

6. The racket of claim 1 wherein:

said striking face defines a plane; and said frame includes a slit in said plane of said striking face;

said striking face being inserted into said slit in said frame.

7. The racket of claim 1 wherein:

said frame at said one lateral end portion thereof has a pocket bore defined therein opening adjacent to said top portion of said frame and closed adjacent to said bottom portion of said frame; and said shaft having an end portion received into said pocket bore of said frame and attached to said frame.

8. The racket of claim 7 wherein said pocket bore of said frame and said end portion of said shaft are configured such that said end portion of said shaft is detachably attached in said pocket bore of said frame.

9. Racket for a ball to be hit and guided at the ground, said racket comprising:

(a) a frame of a oval shape and surrounding a central opening defined through said frame, said frame having opposite arcuate-shaped top and bottom portions being oppositely curved away from one another and opposite arcuate-shaped lateral end portions extending between said top and bottom portions and being oppositely curved away from one another so as to provide said frame with the oval shape;

(b) a striking face having a pair of opposite sides and being mounted to said frame and extending across said central opening of said frame such that said frame and said striking face together substantially resemble a head of a tennis racket; and (c) an elongated shaft being substantially straight and joined at one end with said frame at one of said arcuate-shaped lateral end portions thereof and extending therefrom;

(d) said bottom portion of said frame being wider than said top portion thereof in cross section and having a middle section and opposite end sections extending away from said middle section such that said bottom portion of said frame is wider at said middle section than at said opposite end sections so as to provide said bottom portion of said frame with opposite convex configurations protruding away from said opposite sides of said striking face that reinforce said bottom portion of said frame to withstand coming into contact with the ground during play.

10. The racket of claim 9 wherein said striking face is formed by strings.

11. The racket of claim 9 wherein said striking face is formed by a plastic grid.

12. The racket of claim 11 wherein said plastic grid closes a central portion of said central opening of said frame.

13. The racket of claim 9 wherein said frame at said bottom portion thereof has a bottom surface and opposite inner faces adjacent to said bottom surface, each of said inner faces being concavely shaped and converging with one of said opposite sides of said striking face and with said bottom surface of said frame to form therewith a sharply cornered angle.

14. The racket of claim 9 wherein said striking face has a pair of opposite sides providing said striking face in cross section in the shape of a two-sided concavity.

15. Racket for a ball to be hit and guided at the ground, said racket comprising:

(a) a frame of an annular shape and surrounding a central opening, said frame having opposite arcuate-shaped top and bottom portions and opposite arcuate-shaped lateral end portions extending between said top and bottom portions:

(b) a striking face mounted to said frame and extending across said central opening of said frame, said striking face having a pair of opposite sides providing said striking face in cross section in the share of a two-sided concavity; and (c) an elongated shaft joined with said frame at one of said arcuate-shaped lateral end portions thereof and extending therefrom;

(d) said bottom portion of said frame being wider than said top portion thereof in cross section so as reinforce said bottom portion of said frame to withstand coming into contact with the ground during play;

(e) said two-sided concavity of said striking face being formed by two string faces intersecting each other from said top portion towards said bottom portion of said frame.

16. The racket of claim 9 wherein:

said striking face defines a plane; and said frame includes a slit in said plane of said striking face;

said striking face being inserted into said slit in said frame.

17. The racket of claim 9 wherein said frame at said one lateral end portion thereof defines a joint detachably receiving an end of said shaft such that said shaft is replaceable.

18. The racket of claim 9 wherein said shaft is constructed of parts being telescopicable relative to one another.

19. The racket of claim 9 wherein:

said frame at said one lateral end portion thereof has a pocket bore defined therein opening adjacent to said top portion of said frame and closed adjacent to said bottom portion of said frame; and said shaft having an end portion received into said pocket bore of said frame and attached to said frame.

20. The racket of claim 19 wherein said pocket bore of said frame and said end portion of said shaft are configured such that said end portion of said shaft is detachably attached in said pocket bore of said frame.

21. Racket for a ball to be hit and guided at the ground, said racket comprising:

(a) a frame of an oval shape and surrounding a central opening defined through said frame, said frame having opposite arcuate-shaped top and bottom portions being oppositely curved away from one another and opposite arcuate-shaped lateral end portions extending between said top and bottom portions and being oppositely curved away from one another so as to provide said frame with the oval shape;

(b) a striking face mounted to said frame and having a grid structure extending across said central opening of said frame such that said frame and said striking face together substantially resemble a head of a tennis racket, said striking face having a pair of opposite sides, said bottom portion of said frame having a bottom surface and opposite inner faces adjacent to said bottom surface, each of said inner faces being concavely shaped and converging with one of said opposite sides of said striking face and with said bottom surface to form therewith a sharply cornered angle, said bottom portion of said frame also having a middle section and opposite end sections extending away from said middle section such that said bottom portion in cross section is wider at said middle section than at said opposite end sections so as to protrude in opposite directions away from said opposite sides of said striking face and reinforce said bottom portion of said frame to withstand coming into contact with the ground during play; and (c) an elongated shaft being substantially straight and joined at one end with said frame at one of said arcuate-shaped lateral end portions thereof and extending from said frame in a generally tangential relationship to said frame.

* * * * *